US011815056B2

(12) United States Patent
Lee

(10) Patent No.: US 11,815,056 B2
(45) Date of Patent: Nov. 14, 2023

(54) METHOD OF MANUFACTURING ORIFICE

(71) Applicant: KOREA AEROSPACE RESEARCH INSTITUTE, Daejeon (KR)

(72) Inventor: Jisung Lee, Daejeon (KR)

(73) Assignee: KOREA AEROSPACE RESEARCH INSTITUTE, Daejeon (KR)

( * ) Notice: Subject to any disclaimer, the term of this patent is extended or adjusted under 35 U.S.C. 154(b) by 738 days.

(21) Appl. No.: 16/813,393

(22) Filed: Mar. 9, 2020

(65) Prior Publication Data

US 2021/0122129 A1 Apr. 29, 2021

(30) Foreign Application Priority Data

Oct. 29, 2019 (KR) ..... 10-2019-0134999

(51) Int. Cl.
*F02M 61/18* (2006.01)
*B21D 41/04* (2006.01)
*B05B 17/04* (2006.01)

(52) U.S. Cl.
CPC ..... *F02M 61/18* (2013.01); *B21D 41/04* (2013.01); *B05B 17/04* (2013.01); *Y10T 29/49432* (2015.01); *Y10T 29/49433* (2015.01)

(58) Field of Classification Search
CPC ..... B21D 41/04; Y10T 29/49432; Y10T 29/49433; B21K 21/08; B21K 21/12; B21K 21/16
See application file for complete search history.

(56) References Cited

U.S. PATENT DOCUMENTS 3,584,792 A * 6/1971 Johnson ..... B05B 7/00 239/338
4,031,745 A * 6/1977 McCarty ..... F28F 1/025 138/119
6,718,860 B2 * 4/2004 Mitsukawa ..... F28F 9/182 83/862
9,486,830 B1 * 11/2016 Fugere ..... B21K 21/16
10,113,811 B2 * 10/2018 Wilkins ..... F28F 1/022
(Continued)

FOREIGN PATENT DOCUMENTS

JP H1176870 A 3/1999
KR 101778118 B1 9/2017
KR 101831303 B1 2/2018

OTHER PUBLICATIONS

Lee et al., Jisung, "Development of capillary tube orifice for high pressure and low flow rate in launch vehicle," 28th Space Cryogenics Workshop, Heritage Hotel, Southbury, Connecticut, pp. 1-2, Jul. 17-19, 2019.

(Continued)

*Primary Examiner* — Sarang Afzali
(74) *Attorney, Agent, or Firm* — HAUPTMAN HAM, LLP

(57) ABSTRACT

A method of manufacturing an orifice is provided to make the orifice capable of spraying a very small amount of fluid in an ultra-high pressure and very low temperature environments. The method also makes it possible to provide the orifice with reduced volume and mass. More specifically, the method effectively realizes a desired hydraulic performance through a simple manufacturing method in which a part of a capillary pipe is pressed to form a channel region having a cross section close to a rectangular shape.

5 Claims, 16 Drawing Sheets

(56) References Cited

U.S. PATENT DOCUMENTS

2006/0277742 A1* 12/2006 Wentzel ..... B21D 51/2676
29/458

OTHER PUBLICATIONS

Lee et al., Jisung, "Development of orifice suitable for use in high pressure/low flow rate and the analysis of experimental results in cryogenic temperature," 2018 KSPE Fall Conference, The Westin Chosun Busan, pp. 1-4, Dec. 21, 2018.
Korean Office Action issued in corresponding Korean Application No. 10-2019-0134999 dated Aug. 20, 2020, pp. 1-5.

* cited by examiner

Pressed length is fixed at 158 mm

Pressing force is fixed at 60 kN

Pressing force is fixed at 60 kN
Pressed length is fixed at 50 mm

METHOD OF MANUFACTURING ORIFICE

CROSS-REFERENCE TO RELATED APPLICATIONS

This application claims priority under 35 U.S.C. § 119 to Korean Patent Application No. 10-2019-0134999, filed on Oct. 29, 2019, in the Korean Intellectual Property Office, the disclosure of which is incorporated herein by reference in its entirety.

TECHNICAL FIELD

The following disclosure relates to a method of manufacturing an orifice and an orifice manufactured by the same, and more particularly, to a method of manufacturing an orifice capable of smoothly realizing desired pressure and flow rate conditions even in environmental conditions of which implementation is difficult, such as ultra-high pressure and low flow rate conditions, and an orifice manufactured by the same.

BACKGROUND

An orifice is a device provided on a channel through which a fluid flows and adjusting a pressure and a flow rate of the flowing fluid. In principle, the orifice is configured to adjust the pressure and the flow rate by changing a channel resistance of the channel through which the fluid flows. Generally, the orifice has the simplest form of realizing this principle, and has a form in which a vent hole is formed in a plate installed to block the channel. Alternatively, the orifice has a form in which a capillary tube having a small diameter and a large length enters the middle of the channel.

Meanwhile, currently, Korean space launch vehicles use an engine that uses liquid oxygen as an oxidant. Since such an engine may be stably ignited in a state where it is cooled to a level similar to the liquid oxygen, an oxidant recirculation process of cooling the engine and components such as pipes connected to the engine by allowing the liquid oxygen present in an oxidizer to flow to an engine main pipe is performed before the engine of the launch vehicle is ignited. The oxidant recirculation process will be described in more detail. The liquid oxygen is circulated to the engine until the engine is sufficiently cooled through a closed loop including a supply line supplying the liquid oxygen from the oxidizer tank to the engine and a circulation line returning the liquid oxygen from the engine to the oxidizer tank. In this case, a small amount of helium gas is injected and sprayed into the circulation line so that the liquid oxygen may more smoothly return to the oxidizer tank. By spraying the helium gas into the circulation line, a flow of the liquid oxygen returning to the oxidizer tank is further activated by kinetic energy and buoyancy of the helium gas, such that a recirculation flow may be more smoothly performed.

The helium gas used in the oxidizer recirculation process has ultra-high pressure and very low temperature states of about 22 MPa and 90K (−183° C.), and a flow rate of the helium gas supplied to the circulation line is appropriately about 1 g/s. In order to spray a fluid having an ultra-high pressure and a very low temperature by a very small amount, a design in which an orifice having a very small hole whose diameter is about 0.1 mm needs to be used is derived. However, it is very difficult to manufacture such a small orifice, and it is likely that the orifice will be blocked by foreign materials due to the very small diameter. Particularly, it is likely that ice particles will be generated due to a small amount of residual gas such as carbon dioxide or moisture included in the pipe or helium gas in a very low temperature environment, and a risk that the orifice will be blocked by such ice particles is further increased.

When it is not smooth for a single orifice to spray a fluid having a high pressure by a low flow rate, a multi-stage orifice in which a plurality of orifices are arranged in series is used or an orifice having a capillary pipe form is used. Korean Patent Registration No. 1778118 (entitled "Steam Generator of Printed Circuit Heat Exchanger Type Having Orifice and filed on Sep. 14, 2017) discloses a technology in which a pressure and a flow rate are adjusted using a multi-stage orifice implemented by a concave-convex structure formed on a channel using a chemical etching method, and Korean Patent Registration No. 1831303 (entitled "Viscometers and Method of Measuring Liquid Viscosity" and filed on Feb. 14, 2018) discloses a technology of adjusting a pressure and a flow rate using a long capillary tube.

However, even with such multi-stage orifice or capillary pipe, in order to realize all of the ultra-high pressure, very low temperature, and very low amount conditions, the number of stages or a length of the capillary pipe is excessively increased, which may cause other problems. Actually, a multi-stage orifice manufactured in a form in which twenty orifices having a hole diameter of 0.5 mm are arranged in series has been currently used in an oxidizer recirculation line of the launch vehicle described above. It has been known that an entire length of the multi-stage orifice is about 200 mm, an entire diameter of the multi-stage orifice is about 50 mm, and a weight of the multi-stage orifice is about 1 kg. In a case of using such a multi-stage structure, hydraulic performance can be satisfied, but a problem that a volume and a mass of an orifice component itself are excessively increased occurs. In a case of using an orifice having a capillary pipe form, a length of the capillary pipe is significantly increased, such that a volume increase problem becomes more serious. Particularly, in a case of the launch vehicle, the necessity to reduce a volume and a mass of each component is very high, and such an excessive volume and mass increase problem needs to be solved.

RELATED ART DOCUMENT

Patent Document

1. Korean Patent Registration No. 1778118 (entitled "Steam Generator of Printed Circuit Heat Exchanger Type Having Orifice and filed on Sep. 14, 2017)
2. Korean Patent Registration No. 1831303 (entitled "Viscometers and Method of Measuring Liquid Viscosity" and filed on Feb. 14, 2018)

SUMMARY

An embodiment of the present invention is directed to providing a method of manufacturing an orifice capable of spraying a very small amount of fluid in ultra-high pressure and very low temperature environments and reducing a volume and a mass, and an orifice manufactured by the same. More specifically, an embodiment of the present invention is directed to providing a method of manufacturing an orifice capable of manufacturing an orifice effectively realizing a desired hydraulic performance by a simple manufacturing method of allowing a channel region having a cross section close to a rectangular shape to be formed by pressing a part of a capillary pipe, and an orifice manufactured by the same.

In one general aspect, a method of manufacturing an orifice includes: a body portion preparing step of preparing a body portion in which a hollow having a circular cross section is formed; a stress value calculating step of calculating a stress value required for a predetermined desired flow rate value according to the following relationship equation-between a flow rate and a stress:

$$\dot{m} = C_1 e^{C_2 S} \text{ or } S = \frac{1}{C_2}\ln\left(\frac{\dot{m}}{C_1}\right),$$

wherein $\dot{m}$ is the flow rate (g/s), S is the stress (N/m$^2$) and S=F/WL, F is a pressing force (N), W is a width (m) of a pressed portion, L is a length (m) of the pressed portion, $C_1$ is a positive constant (g/s), and $C_2$ is a negative constant (m$^2$/N); and a pressed portion manufacturing step of manufacturing the pressed portion in which the hollow becomes a slit by pressing at least a partial region of the body portion with the pressing force corresponding to a value of the stress calculated in the stress value calculating step.

In the stress value calculating step, values of C1 and C2 may be determined by at least one selected among an outer diameter, a thickness of a wall, and a material of the body portion.

In the pressed portion manufacturing step, an area value of the pressed portion may be calculated according to the following relationship equation:

$$A = WL = \left(2_t + \frac{\pi D_i}{2}\right)L,$$

wherein A is an area (m$^2$) of the pressed portion, W is the width (m) of the pressed portion, L is the length (m) of the pressed portion, t is a thickness (m) of a wall of the body portion, and $D_i$ is an inner diameter (m) of the body portion, and the pressing force value may be calculated from the following relationship equation: F=SA, wherein F is the pressing force (N), S is the Stress (N/m$^2$), and A is the area (m$^2$) of the pressed portion.

In another general aspect, an orifice is an orifice 100 manufactured by the method of manufacturing an orifice as described above, includes: the body portion 110 in which the hollow 111 through which a fluid passes and which has the circular cross section is formed; and the pressed portion 120 formed by pressing at least the partial region of the body portion so that the hollow 111 becomes the slit 121.

The pressed portion 120 may be formed in a region between both ends of the body portion 110. The pressed portion 120 may be formed from one end portion of the body portion 110 to the other end portion of the body portion 110.

The body portion 110 may have a linear shape. Alternatively, the body portion 110 may have a non-linear shape.

DETAILED DESCRIPTION OF MAIN ELEMENTS

Figure 1:
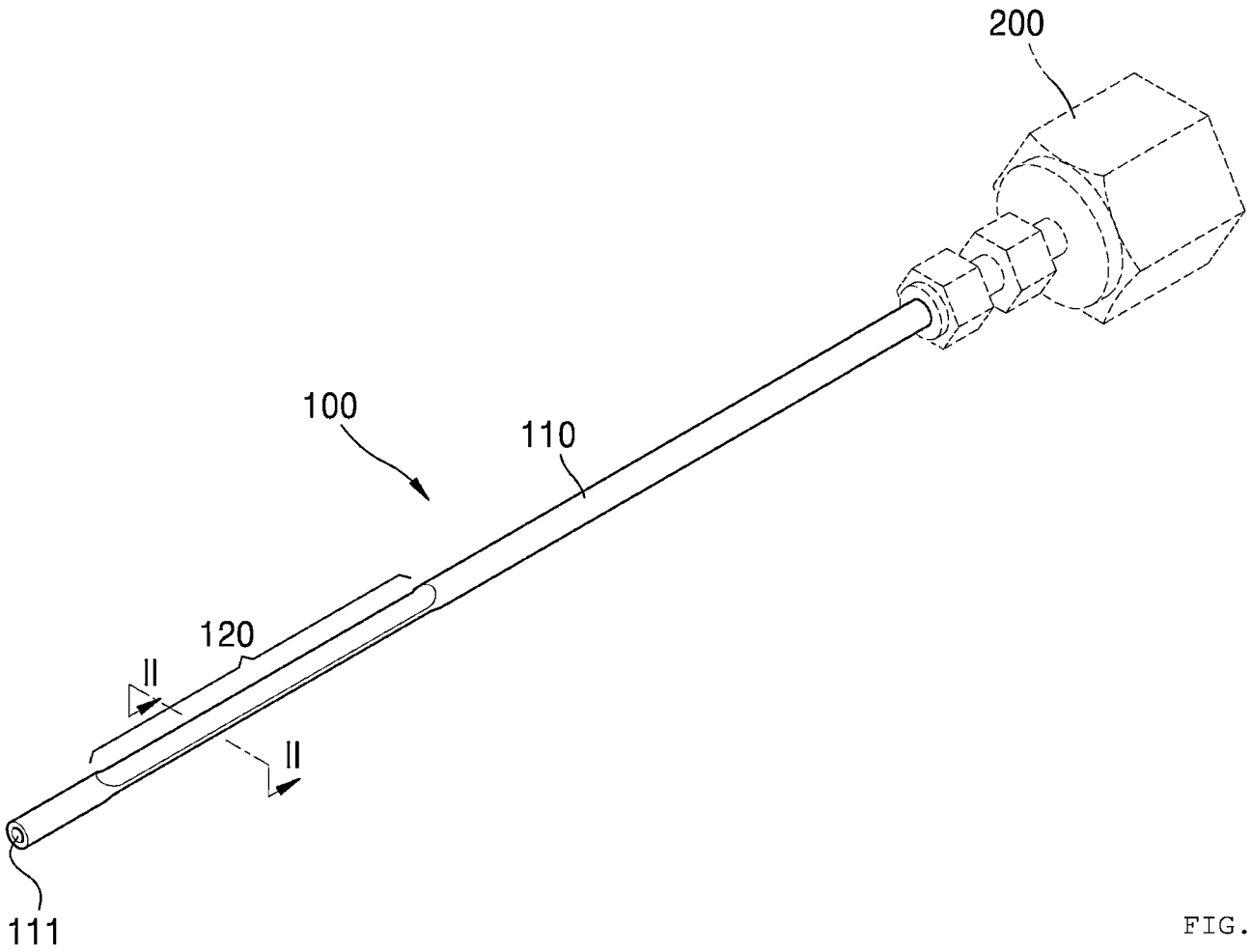
FIG. 1 is a view illustrating an embodiment of an orifice according to the present invention.

100: orifice
110: body portion
111: hollow
120: pressed portion
121: slit
200: connector

DETAILED DESCRIPTION OF EMBODIMENTS

Here, a method of manufacturing an orifice according to the present invention and an orifice manufactured by the same having the configuration as described above will be described with reference to the accompanying drawings.

[1] Basic Configurations of Orifice and Method of Manufacturing the Same According to the Present Invention FIG. 1 illustrates an embodiment of an orifice according to the present invention. An entire shape of an orifice 100 according to the present invention will be first described with reference to FIG. 1. The orifice 100 according to the present invention includes a body portion 110 in which a hollow 111 is formed and a pressed portion 120 formed in a flat shape by pressing at least a partial region of the body portion 110. A connector 200 used to connect the orifice 100 to a pipe is illustrated in FIG. 1, and it is illustrated for convenience that the connector 200 is present only in one end portion of the orifice 100, but the present invention is not limited thereto. Actually, in a case where the orifice 100 is connected to the pipe, the connectors 200 may be used at both end portions of the orifice 100.

Figure 2:
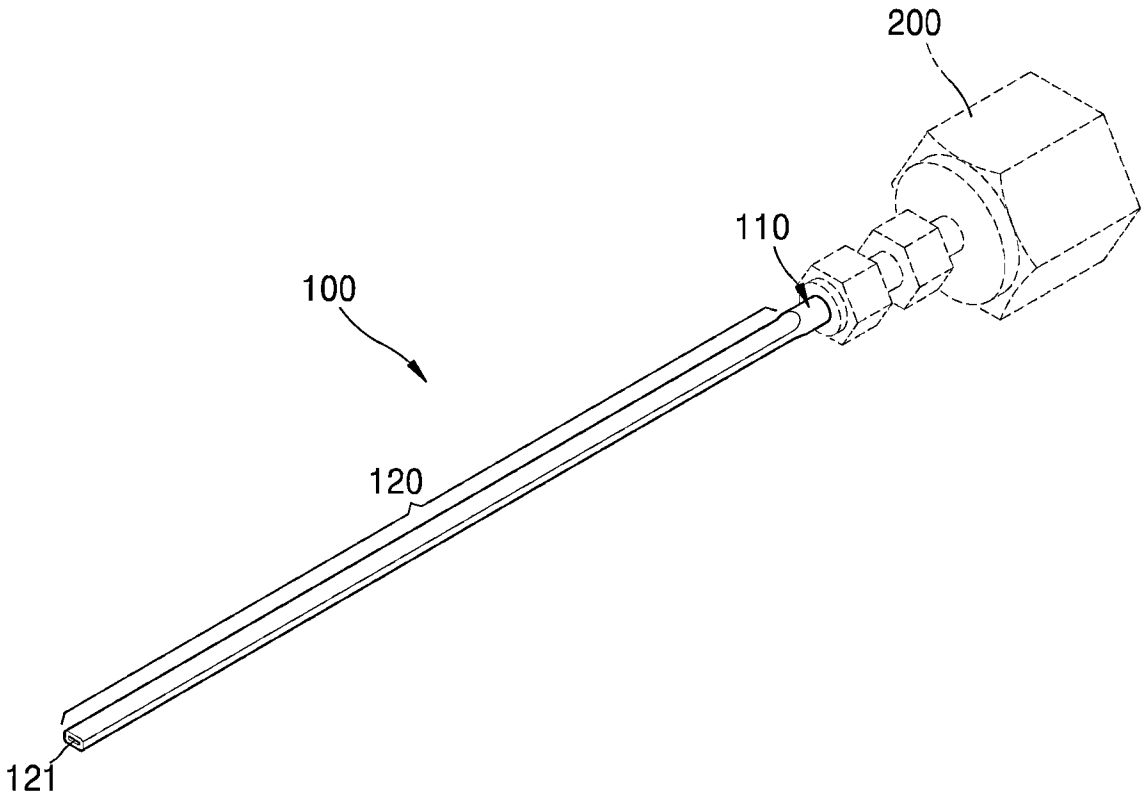
FIG. 2 is a view illustrating another embodiment of an orifice according to the present invention.
Figure 3:
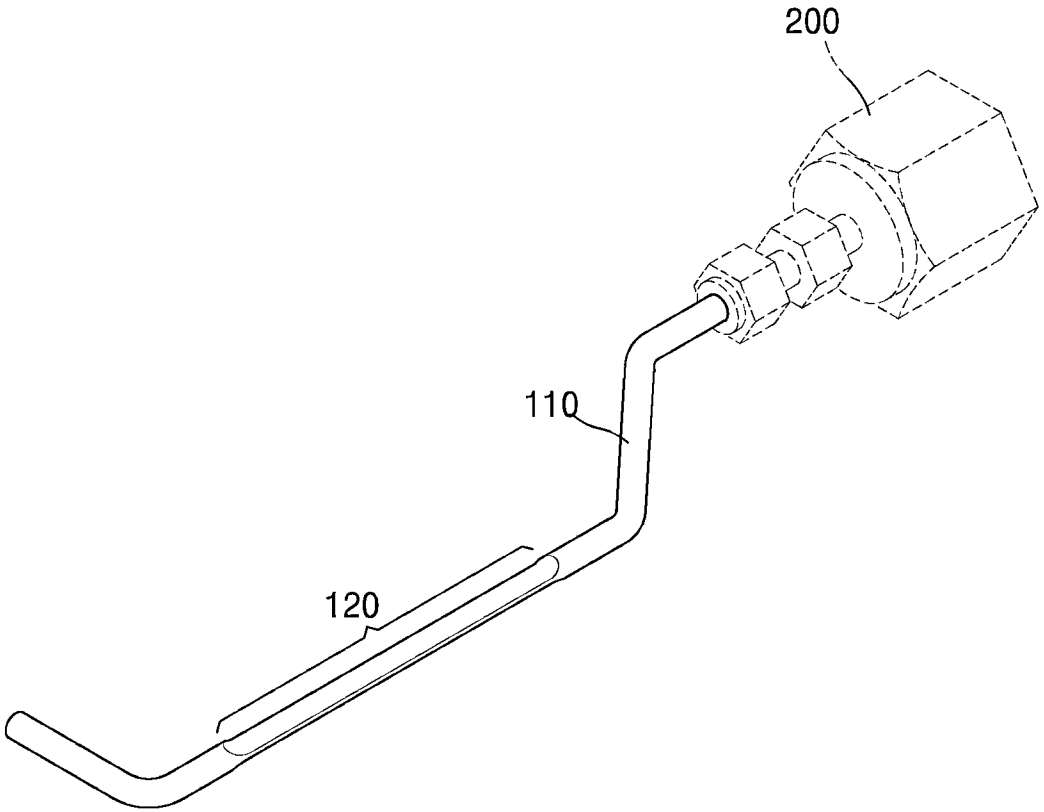
FIG. 3 is a view illustrating still another embodiment of an orifice according to the present invention.

In addition, the pressed portion 120 may be formed in a region between both end portions of the body portion 110, that is, a partial region, as illustrated in FIG. 1, or may be formed from one end portion of the body portion 110 to the other end portion of the boy portion 110, as illustrated in another embodiment of FIG. 2. In addition, the body portion 110 may be formed in a linear shape as illustrated in FIGS. 1 and 2, or may be formed in a non-linear shape as illustrated in still another embodiment of FIG. 3. That is, a shape of the body portion 110 and a region length of the pressed portion 120 may be variously changed, as needed.

Figure 4:
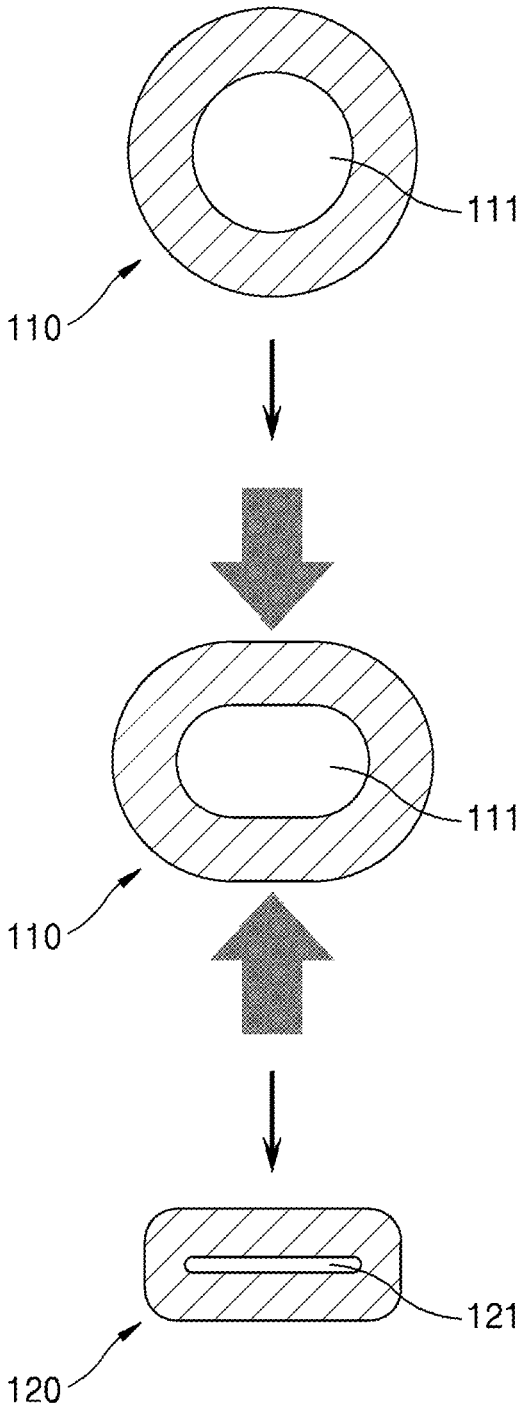
FIG. 4 is cross-sectional views illustrating a pressed portion in a process of manufacturing an orifice according to the present invention.

A basic configuration of a method of manufacturing the orifice 100 will be briefly described below. FIG. 4 sequentially illustrates cross-sectional views of a pressed portion in a process of manufacturing an orifice according to the present invention. First, in a body portion preparing step, the body portion 110 in which the hollow 111 having a circular cross section is formed is prepared. An uppermost drawing of FIG. 4 illustrates the body portion preparing step. Next, in a stress value calculating step, a stress value required for a predetermined desired flow rate value is calculated according to a relationship equation between a flow rate and a stress (in this case, how the relationship equation between the flow rate and the stress is derived will be described in more detail in a paragraph '[2] Detailed Construction of Method of Manufacturing Orifice According to the Present Invention and Derivation Principle'). Finally, in a pressed portion manufacturing step, the pressed portion 120 in which the hollow 111 becomes a slit 121 is manufactured by pressing at least a partial region of the body portion 110 with a pressing force corresponding to the stress value calculated in the stress value calculating step. Middle and lowermost drawings of FIG. 4 illustrate an intermediate process and a completed state of the pressed portion manufacturing step, respectively.

That is, in short, a portion of a raw material formed in a general capillary pipe shape, that is, a circular tube shape having the hollow 111 through which a fluid passes and which has the circular cross section is pressed, such that a pressed region becomes the pressed portion 120 and the remaining region that is not pressed and maintains an original shape becomes the body portion 110. As a shape of the pressed portion 120 becomes a flatly pressed shape, the hollow 111 in a region corresponding to the pressed portion 120 is also flatly pressed in a pressing process even though it originally has the circular cross section, such that the hollow 111 becomes the slit 121 having a cross-sectional shape close to a rectangular shape that is thin and elongated.

The slit 121 manufactured in the rectangular cross-sectional shape that is thin and elongated as described above becomes an element serving to control a fluid pressure and a flow rate of the orifice 100. As well-known, the orifice changes a speed and a flow rate by increasing a channel resistance using a structure in which a channel shape is rapidly changed in principle. Also in the orifice 100 according to the present invention, when a fluid flows through the hollow 111 formed in the body portion 110 and having the circular cross section and then flows to the slit 121 formed in the pressed portion 120, a channel shape, a channel cross-sectional area, and the like, are changed, such that a flow velocity and a flow rate are naturally reduced. In this case, the orifice 100 according to the present invention may obtain hydraulic performance similar to that of a multi-stage orifice according to the related art, that is, a multi-stage orifice manufactured by connecting several orifices having circular holes to each other in series only by forming the pressed portion 120 in which the slit 121 is formed (This will be described in more detail in a paragraph '[3] Confirmation of Performance of Orifice According to the Present Invention').

As such, in the method of manufacturing an orifice according to the present invention, the orifice effectively realizing a desired hydraulic performance may be very easily and smoothly manufactured through a simple manufacturing of forming a channel region having a cross section close to a rectangular shape by pressing a part of the capillary pipe. It has been described above that the orifice according to the related art used in order to spray the very small amount of fluid in the ultra-high pressure in the oxidant recirculation process of the launch vehicle needs to use the multi-stage structure in order to obtain the desired hydraulic performance. Conventionally, in a process of manufacturing such a multi-stage orifice, processes such as an assembling process, an aligning process, and the like, have been required, and there was a problem such as an excessive increase in a volume and a mass. However, in the present invention, the orifice is formed of a single component, and a volume and a mass of the orifice may thus be reduced as compared with the multi-stage orifice according to the related art. Therefore, miniaturization and lightness of the orifice may be easily realized. Furthermore, since the orifice is formed of the single component, processes such as an assembling process, an aligning process, and the like, are not required at the time of manufacturing the orifice, such that the number of components and the number of processes may be minimized and economical efficiency and productivity are maximized. That is, in a case where the orifice according to the present invention is applied to a device such as a system that conventionally has to endure difficult processes and an excessive volume and mass in order to obtain the desired hydraulic performance, for example, an oxidizer recirculation system of the launch vehicle described above, all the problems occurring by applying the multi-stage orifice according to the related art may be basically solved.

[2] Detailed Construction of Method of Manufacturing Orifice According to the Present Invention and Derivation Principle Hereinafter, a derivation principle of the relationship equation between the flow rate and the stress in the stress value calculating step described above will be described in detail.

Figure 5A:
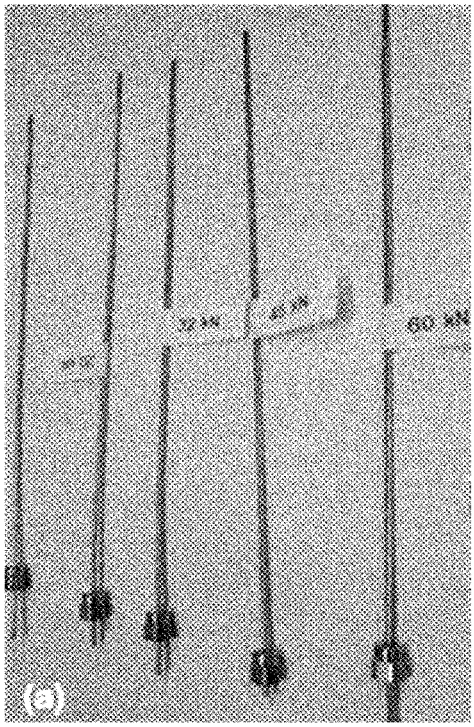
FIGS. 5A to 5C are views illustrating an embodiment of a process of manufacturing an orifice according to the present invention.
Figure 5B:
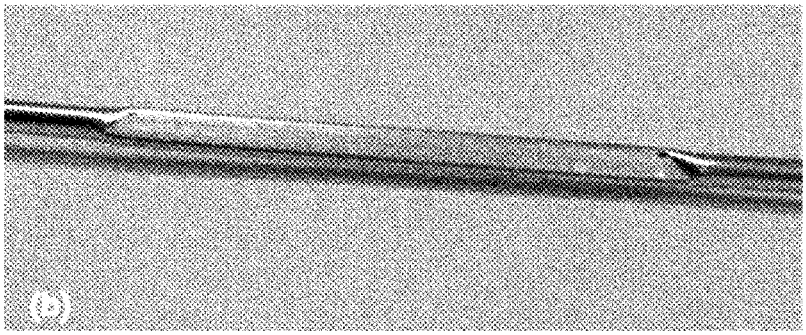
Figure 5C:
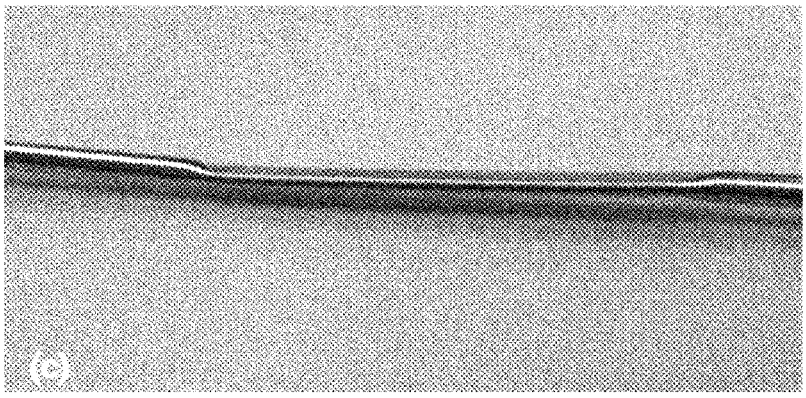

FIGS. 5A to 5C are views illustrating an embodiment of a process of manufacturing an orifice according to the present invention. In detail, the orifice according to the present invention is manufactured by pressing a 1/16 inch stainless steel tube by a press to form a shape as illustrated in FIGS. 5B and 5C. In FIG. 5A, embodiments of orifices manufactured while variously changing a force (that is, a pressing force) with which the stainless steel tube is pressed by the press are illustrated. In this case, as illustrated in FIGS. 5B and 5C, it is easily confirmed with the naked eyes that a flat level is changed depending on a length (that is, a length of the pressed portion) at which the stainless steel tube is pressed by the press and the force (that is, the pressing force) with which the stainless steel tube is pressed by the press.

Figure 6A:
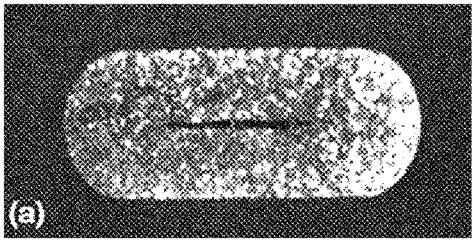
FIGS. 6A to 6F are views illustrating the microscopic cross sectional views of various standards of orifices according to the present invention.
Figure 6B:
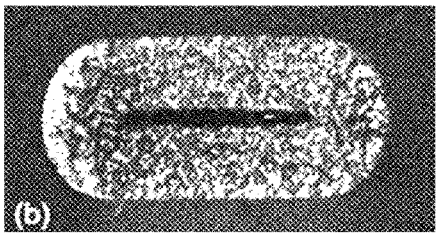
Figure 6C:
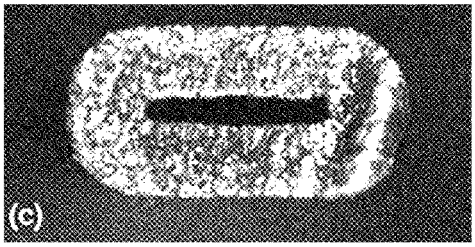
Figure 6D:
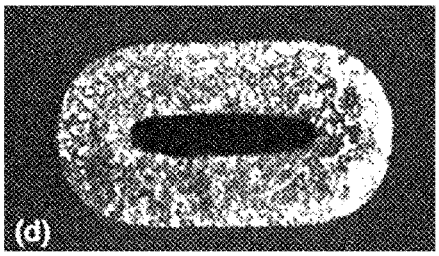
Figure 6E:
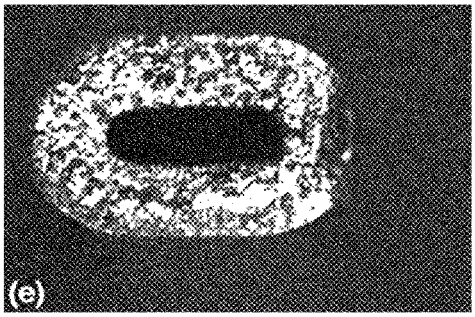
Figure 6F:
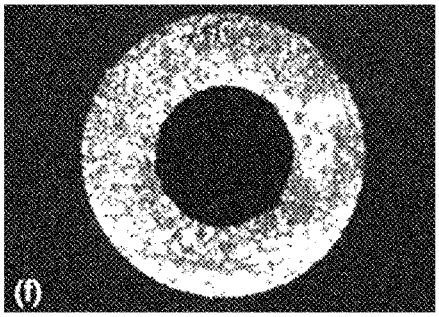

FIGS. 6A to 6F illustrate embodiments of various standards of orifices according to the present invention, and illustrate results obtained by cutting flat portions (that is, pressed portions) of several orifices manufactured by pressing stainless steel tubes with various pressing forces by a wire cutting method and observing the cut flat portions. FIG. 6F illustrates a cross section in an original state before the stainless steel tube is pressed, that is, when a stainless still tube has the same form as that of the body portion having the hollow with the circular cross section, FIGS. 6E to 6A illustrate cross sections of pressed portions manufactured by pressing stainless steel tubes with pressing forces that become gradually strong, respectively, and it may be confirmed that slits become flat and thin as the pressing force becomes strong. Particularly, it may also be confirmed that the slits are formed so that internal channels of the pressed portions do not have twisted forms, but have uniform three-dimensional forms.

Figure 7:
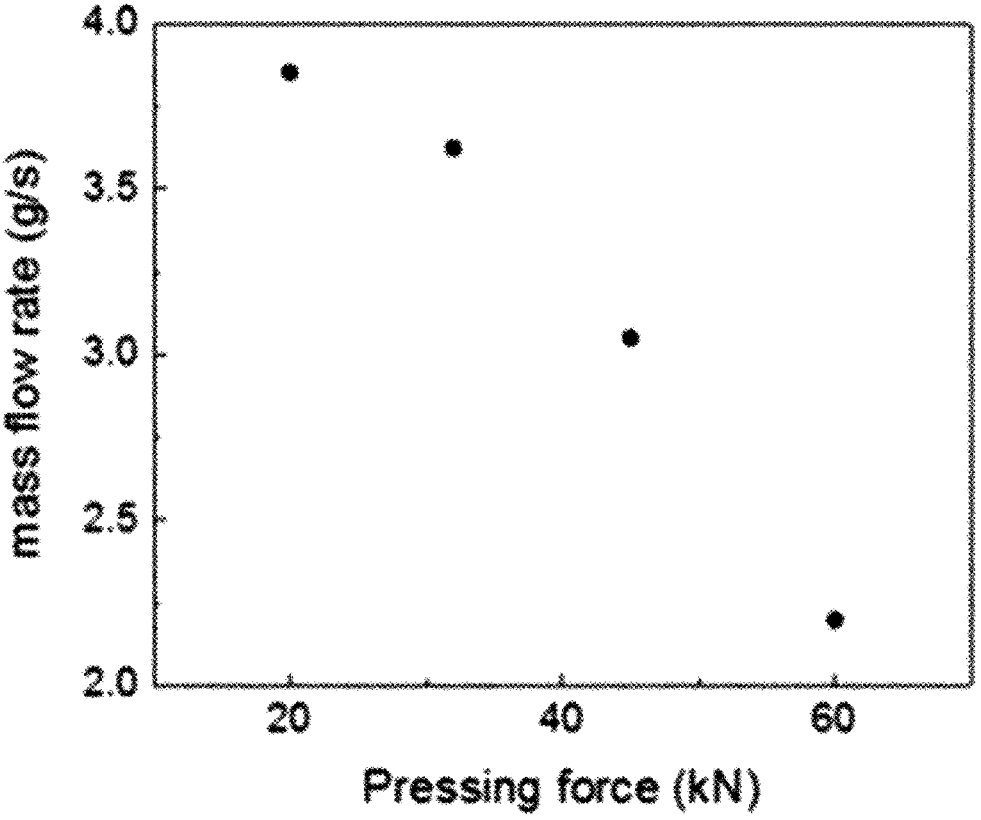
FIG. 7 is a view illustrating a relationship between a pressing force and a flow rate in embodiments of various standards of orifices according to the present invention.

FIG. 7 illustrates a relationship between a pressing force and a flow rate in embodiments of various standards of orifices according to the present invention. In FIG. 7, a helium gas at room temperature was supplied at 22 MPa, a length of the pressed portion was fixed at 158 mm, and measurement was performed while changing only the pressed force. As illustrated in FIG. 7, it may be seen that as the force (that is, the pressing force) with which the stainless steel tube is pressed by the press becomes large, a flow rate of the fluid flowing out through the slit is gradually reduced. It may be inferred that the reason is that as the pressing force becomes large, the pressed portion becomes flatter and the slit thus becomes flatter, such that a space through which the fluid passes is reduced.

Figure 8:
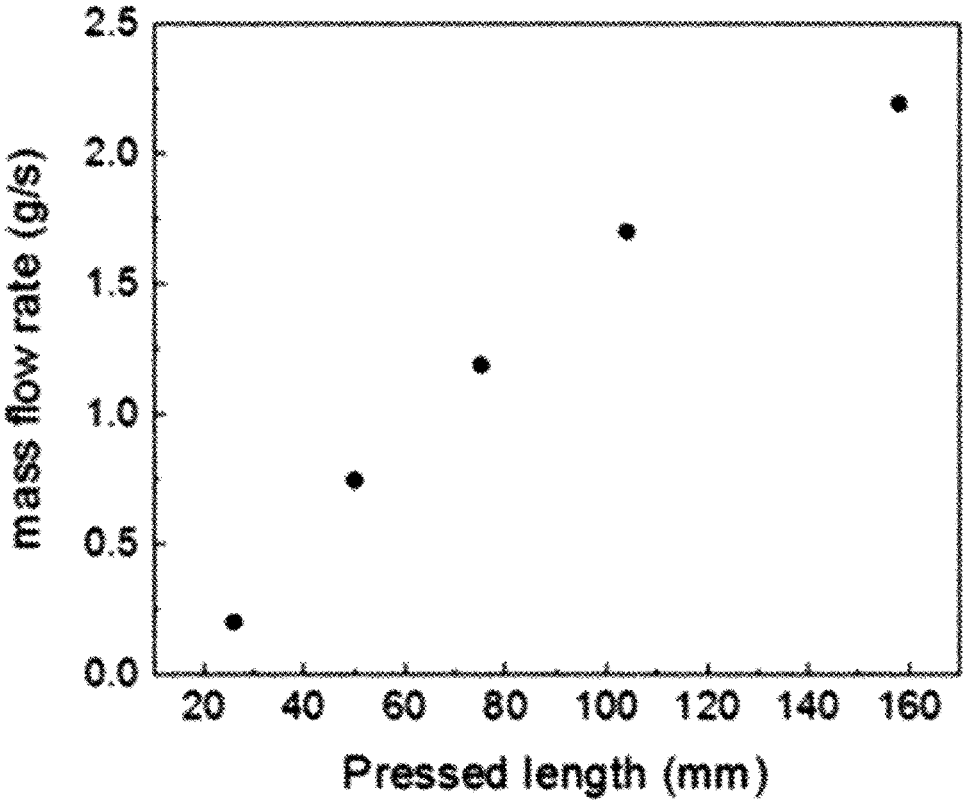
FIG. 8 is a view illustrating a relationship between a length of a pressed portion and a flow rate in embodiments of various standards of orifices according to the present invention.

FIG. 8 illustrates a relationship between a length of a pressed portion and a flow rate in embodiments of various standards of orifices according to the present invention. Also in FIG. 8, a helium gas at room temperature was supplied at 22 MPa, the pressing force was fixed at 60 kN, and measurement was performed while changing only the length of the pressed portion. As illustrated in FIG. 8, it may be seen that as the length of the pressed portion becomes long, the flow rate is gradually increased. It may be inferred that the reason is that when an area in which the pressing force is applied in a state where the pressing force is constant becomes wide, a force applied per unit area is reduced, such that the slit becomes less flat.

Figure 9:
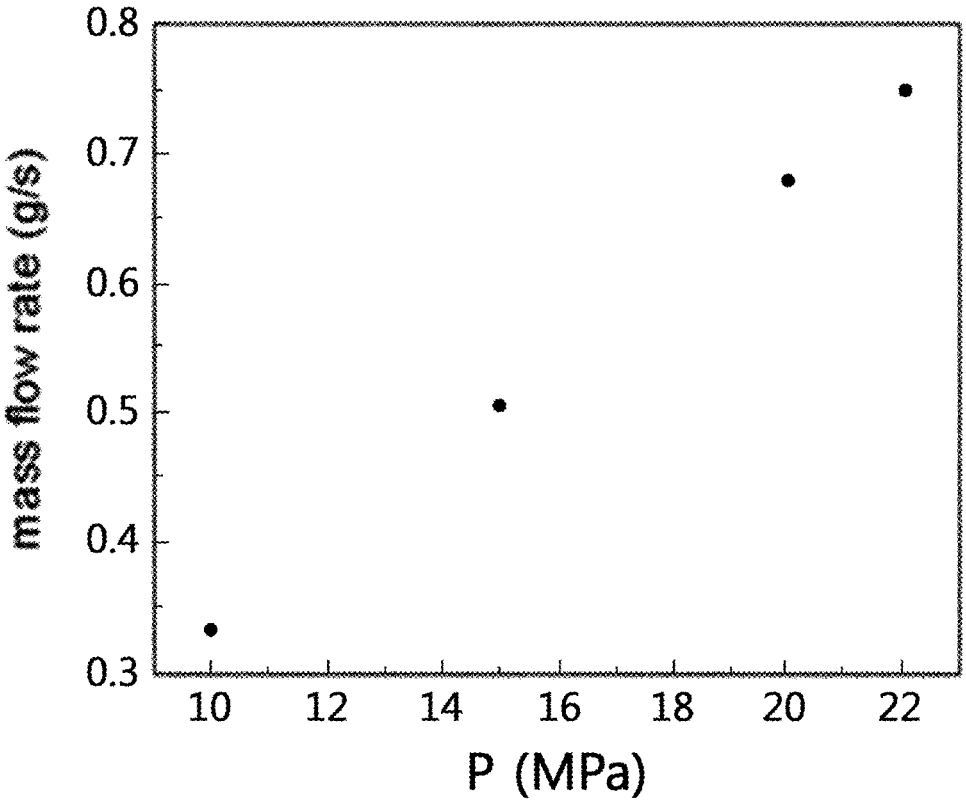
FIG. 9 is a view illustrating a fluid supply pressure-flow rate result of a specific orifice (60 kN pressing force and a 50 mm length) to check the linearity between the supply pressure and the flow rate.

FIG. 9 illustrates a fluid supply pressure-flow rate result in a specific orifice to check the linearity between the supply pressure and the flow rate. More specifically, after a pressed portion having a length of 50 mm is manufactured at a pressing force of 60 kN, a change in a flow rate of the fluid passing through a slit was measured while changing a helium gas supply pressure at room temperature. It may be confirmed that the fluid supply pressure and the flow rate of the fluid passing through the slit have a proportional relationship therebetween as expected and the orifice is normally operated as in an orifice generally used.

Figure 10:
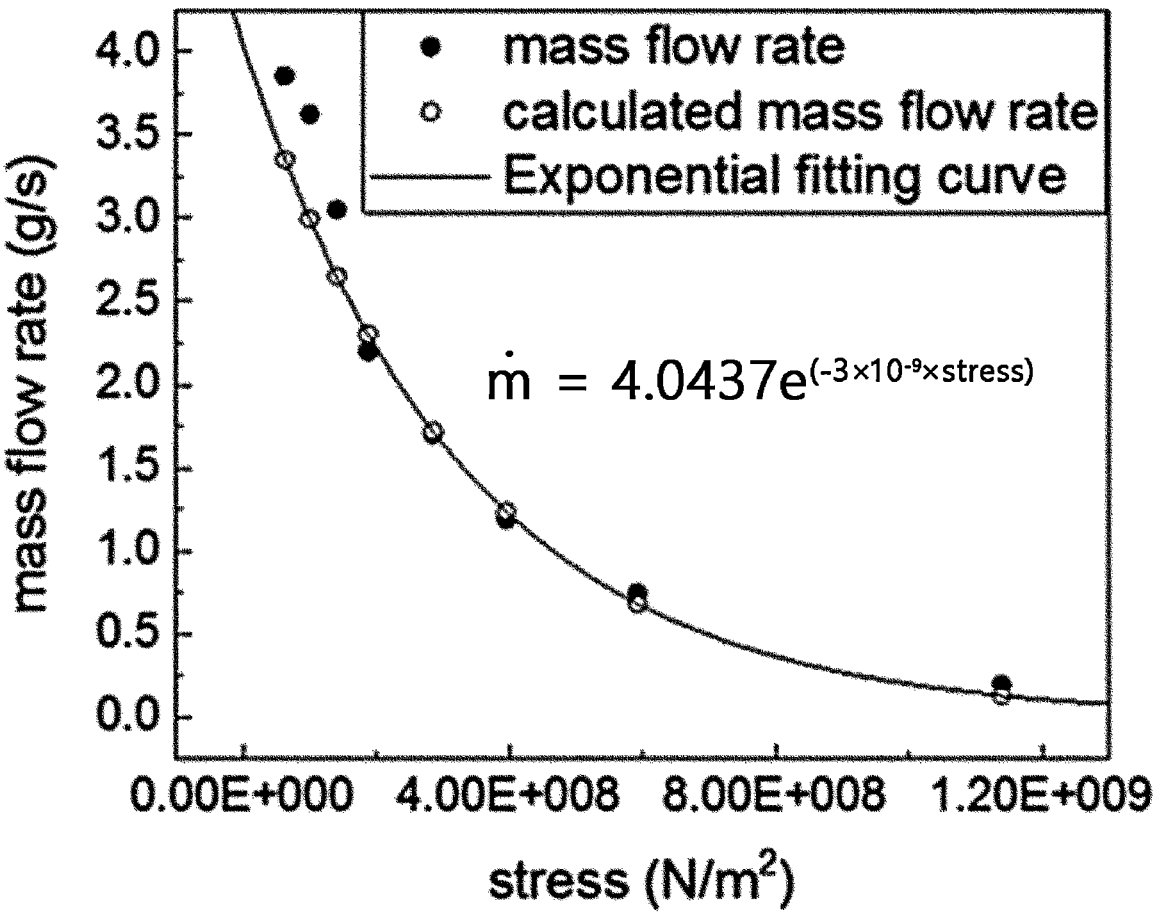
FIG. 10 is a view illustrating a relationship between a stress and a flow rate in embodiments of various standards of orifices according to the present invention.

It may be seen from the result as described above that when the pressing force, the length of the pressed portion, or the like, is adjusted, a desired flow rate of the fluid passing through the slit in the manufactured orifice may be adjusted. On the basis of such a tendency, in the present invention, a relationship equation between a flow rate of the fluid passing through the orifice and a stress acting at the time of manufacturing the orifice was derived. FIG. 10 illustrates a relationship between a stress and a flow rate in embodiments of various standards of orifices according to the present invention as a graph. As illustrated in FIG. 10, it may be seen that a relationship having an exponential function form is established between a flow rate of a fluid passing through the orifice and stress acting at the time of manufacturing the orifice. More specifically, the following relationship equation is established between the flow rate and the stress:

$$\dot{m} = C_1 \exp(C_2 S) \text{ or } S = \frac{1}{C_2} \ln\left(\frac{\dot{m}}{C_1}\right)$$

(here, $\dot{m}$: Flow rate, S: Stress, $C_1$: Positive constant, and $C_2$: Negative constant).

In an equation based on an actual experimental value, $C_1$ is 4.0437 and $C_2$ is $-3*10^{-9}$, but the present invention is not limited thereto. That is, specifically, values of $C_1$ and $C_2$ may be changed depending on an outer diameter, a thickness of a wall, a material, and the like, of the tube used to manufacture the orifice. However, in a case where the material of the tube is stainless steel, the outer diameter of the tube is 1.588 mm (1/16 inch), and the thickness of the wall of the tube is 0.4 mm, the values of $C_1$ and $C_2$ may be used as they are.

When the relationship equation between the flow rate and the stress as described above is derived by a result graph as illustrated in FIG. 10 through such a process, it may be easily determined how much stress the tube is pressed in order to obtain a desired flow rate. However, even though the stress value required for the desired flow rate value is calculated from the relationship equation as described above, a pressing force value that needs to be actually applied by the press needs to be again calculated from this stress value. That is, since an area of the pressed portion (that is, an area of the flatly pressed portion) is changed depending on the length of the pressed portion, the stress needs to be calculated in consideration of this fact. In the present invention, an area value of the pressed portion was calculated from the following relationship equation, and particularly, here, it was assumed that a width W of the pressed portion corresponds to a value obtained by adding the double of the thickness t of the wall to a half ($\pi D_i/2$) of a circumference length of an inner surface of the tube:

$$A = WL = (2t + \pi D_i/2)L$$

(here, A: Area of pressed portion, W: Width of pressed portion, L: Length of pressed portion, t: Thickness of wall of body portion, and $D_i$: Inner diameter of body portion).

When the area of the pressed portion calculated as described above is used, the pressing force value may be easily calculated from the following relationship equation:

$$F = SA$$

(here, F: Pressing force, S: Stress, and A: Area of pressed portion).

As described above, in the present invention, the stress value required in order to obtain the desired flow rate value may be calculated and determined from the relationship equation between the flow rate and the stress having the exponential function form as illustrated in FIG. 10, and the pressing force value required at the time of actually manufacturing the orifice may be calculated and determined using such calculated stress value, originally fixed numerical values such as the inner diameter, the thickness of the wall, and the like, of the tube used for manufacturing the orifice, and the desired length of the pressed portion. That is, according to the present invention, geometric numerical values of an orifice to be manufactured, a force required for manufacturing the orifice, and the like, may be very easily calculated using given hydraulic conditions and a desired hydraulic performance.

[3] Confirmation of Performance of Orifice According to the Present Invention

Figure 11:
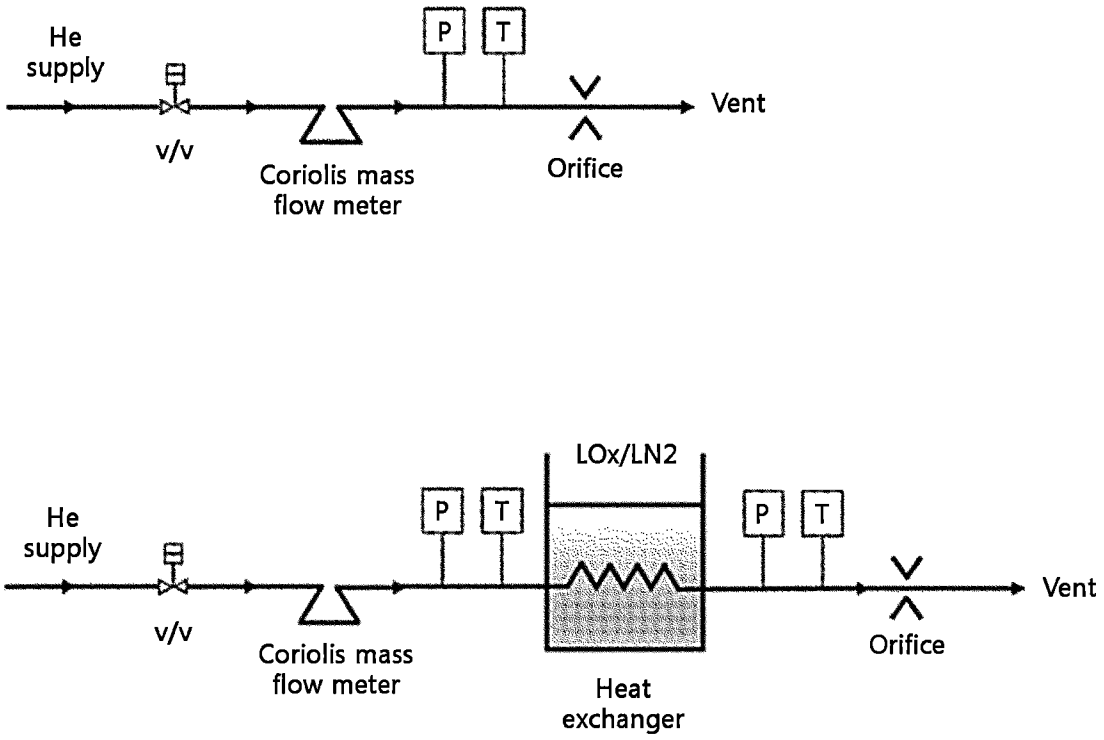
FIG. 11 is views illustrating orifice test systems according to the present invention.

In order to test hydraulic performance of orifices of several standards manufactured as described above, test systems having forms as illustrated in FIG. 11 was configured. A system illustrated in an upper drawing of FIG. 11 is to test orifice performance at room temperature, and a system illustrated in a lower drawing of FIG. 11 is to test orifice performance at a very low temperature and is similar to the system for room temperature but further includes a cooling heat exchanger in the middle. At the time of experiment, in order to make environment conditions similar to those of the oxidizer recirculation system of the launch vehicle described above, a high pressure helium gas of 22 MPa was supplied, and a mass flow rate of the helium gas was measured in a Coriolis mass flow meter disposed in front of the orifice. In addition, a pressure and a temperature in front of the orifice were measured using a pressure sensor and a temperature sensor, respectively. The cooling heat exchanger in the system for a very low temperature cools the helium gas to 90 K (−183° C.), which is a temperature of the oxidizer. In this case, a pressure sensor and a temperature sensor may be further installed in order to measure a pressure and a temperature of the cold helium gas.

Figure 12:
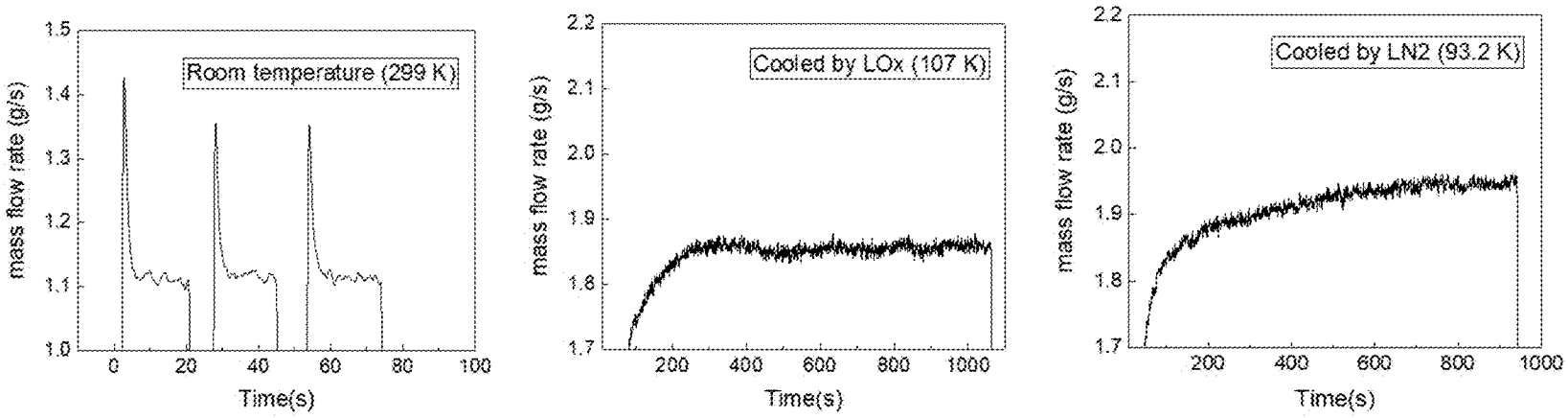
FIG. 12 is a time-flow rate result in an orifice test according to the present invention.

FIG. 12 is result graphs illustrating the hydraulic performance of orifices tested using the test systems as described above as flow rates according to time. A leftmost drawing of FIG. 12 illustrates a result at room temperature, a middle drawing of FIG. 12 illustrates a result at a low temperature cooled by LOx, and a rightmost drawing of FIG. 12 illustrates a result at a low temperature cooled by LN2. As illustrated in FIG. 12, it is confirmed that a flow rate is about 1.1 g/s at room temperature and a flow rate is about 1.8 to 1.9 g/s at a very low temperature. The reason why the flow rate is increased at a very low temperature is that a density of the helium gas is increased as a temperature of the helium gas is lowered, that is, that more mass flow rate of the helium gas flows in the same orifice even though the helium gas passes through the same office.

The following equations are to calculate an effective cross-sectional area in a condition in which a flow velocity of the helium gas reaches at a sound velocity, such that a speed and a mass flow rate are not increased any more, that is, a choking condition. Here, the calculation of the effective cross-sectional area means calculation of an area when a capillary pipe orifice elongated in a length direction is replaced by an orifice formed in a simple hole shape $$A^* = \frac{\dot{m}\beta}{P}$$

$$\beta = \frac{\sqrt{RT}}{\sqrt{k\left(\frac{2}{k+1}\right)^{\frac{k+1}{k-1}}}}$$

(here, A*: Effective cross-sectional area ($mm^2$), $\dot{m}$: Flow rate (kg/s), R: Gas constant, T: temperature (K) in front of orifice, k: Specific heat ratio ($C_p/C_v$), P: Absolute pressure (MPa) in front of orifice).

Figure 13:
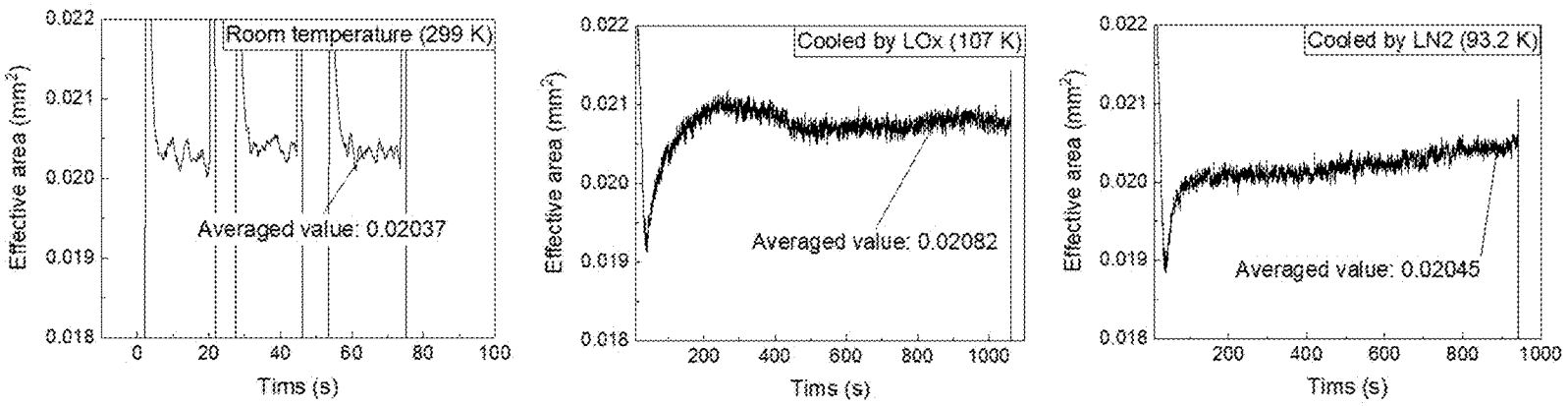
FIG. 13 is an effective cross-sectional area-flow rate result in a choking condition in an orifice test according to the present invention.

FIG. 13 is result graphs illustrating the hydraulic performance of orifices tested in the choking condition using the equations as described above as effective cross-sectional areas according to time. A leftmost drawing of FIG. 13 illustrates a result at room temperature, a middle drawing of FIG. 12 illustrates a result at a low temperature cooled by LOx, and a rightmost drawing of FIG. 12 illustrates a result at a low temperature cooled by LN2. As illustrated in FIG. 13, it is confirmed that a constant effective cross-sectional area appears regardless of whether or not a temperature is a room temperature or a very low temperature. That is, it is shown that the orifice according to the present invention manufactured as described above is operated well at a constant resistance, similar to a general orifice.

Figure 14:
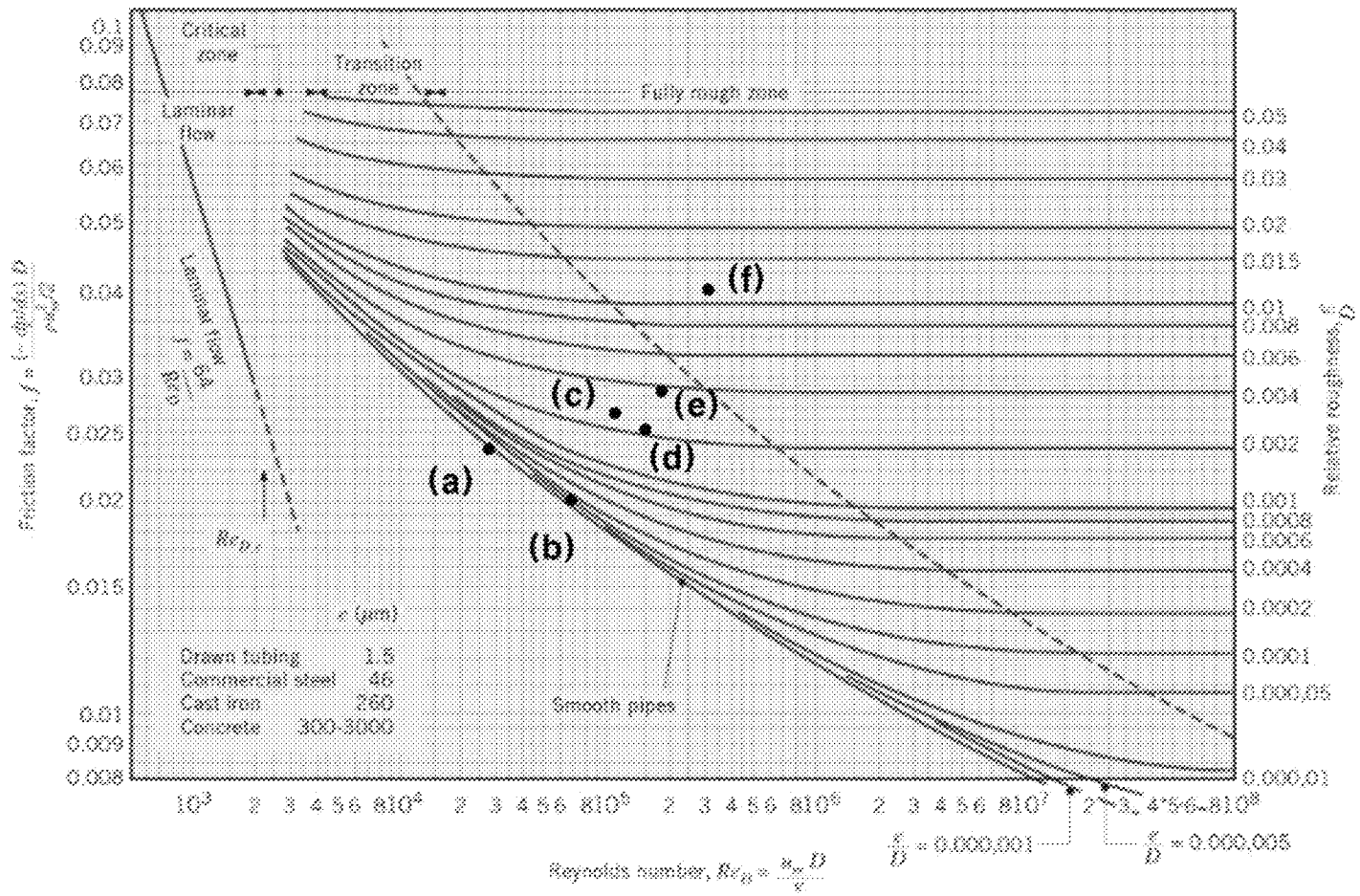
FIG. 14 is a view illustrating flow friction characteristics in embodiments of various standards of orifices according to the present invention.
Figure 15A:
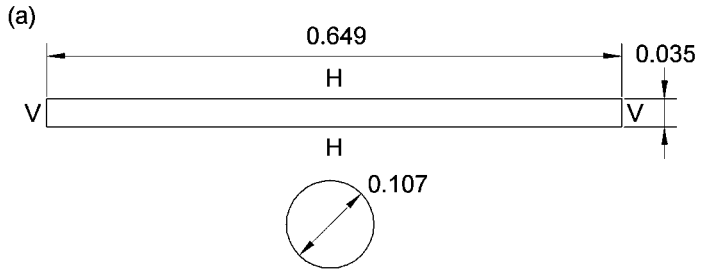
FIGS. 15A to 15E are views illustrating conversion results of actual cross-sectional areas and effective cross-sectional areas in embodiments of various standards of orifices according to the present invention.
Figure 15B:
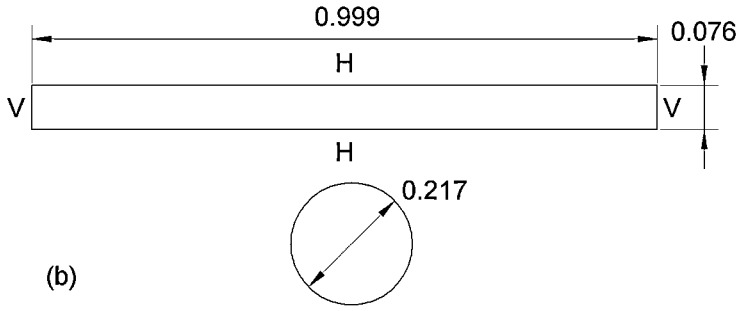
Figure 15C:
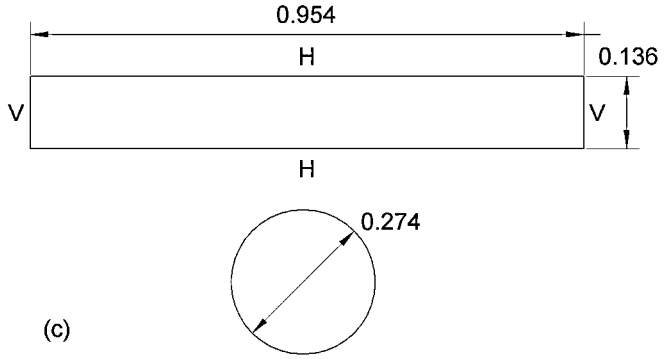
Figure 15D:
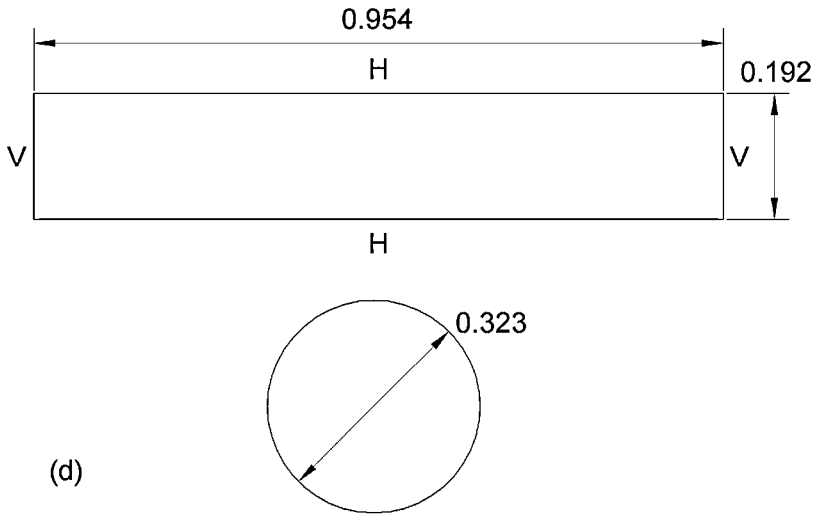
Figure 15E:
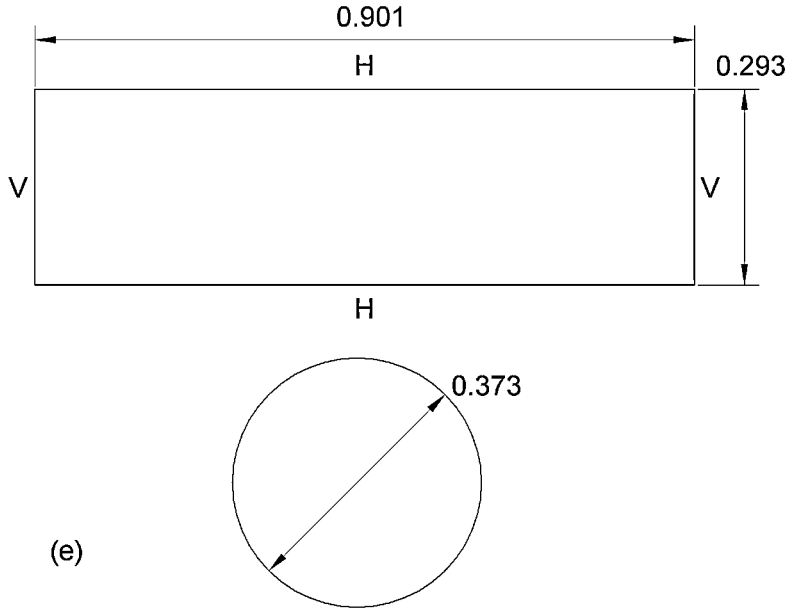

FIG. 14 illustrates flow friction characteristics in embodiments of various standards of orifices according to the present invention, and black dots on graphs indicate result values in each of FIGS. 6A to 6F. Particularly, in FIG. 14, a dot marked above a dotted line denoted by "Transition zone" (a dot closest to "Fully rough zone") indicates a result value of FIG. 6F (that is, an original state before the tube is pressed), and it may be confirmed that result values become close to the graphs denoted by "Smooth pipes" as the pressed portion becomes flat. That, it is confirmed that as the tube is strongly pressed, a surface roughness in the slit is lowered, such that a channel resistant tends to be lowered.

When taking into consideration of such several experiment results, the following interesting tendency is found. That is, the orifices according to the present invention manufactured while changing the force pressing the tube having a predetermined length, a predetermined ratio exists between a cross-sectional area and an effective cross-sectional area. FIGS. 15A to 15E illustrate conversion results of actual cross-sectional areas and effective cross-sectional areas in embodiments of various standards of orifices according to the present invention. Easily describing the results of FIGS. 15A to 15E, when a general orifice (an orifice formed in a plate shape in which a circular hole is simply perforated) having the same channel resistance as that of the orifice according to the present invention is used, an actual cross-sectional area of the orifice according to the present invention is about six times larger than that of the general orifice. That is, in a case of using the general orifice in order to spray a desired very small amount of fluid, the hole needs to be perforated at a very small size, while in a case of using the orifice according to the present invention, a slit may be formed at a size six times larger than the size of the hole of the general orifice. As described above, in a case of forming the hole at an excessively small size, it is difficult to manufacture such an orifice, and there a problem that a case where the hole is blocked by foreign object particles or ice particles or the like in the fluid in a very low temperature environment often occurs. However, when the orifice according to the present invention is used, the same flow rate may be obtained and the slit may be formed to have a much wider cross-sectional area, and the difficulty in manufacturing the orifice or a risk that the hole will be blocked by the ice particles may thus be significantly reduced.

The present invention is not limited to the abovementioned exemplary embodiments, but may be variously applied. In addition, the present invention may be variously modified by those skilled in the art to which the present invention pertains without departing from the gist of the present invention claimed in the claims.

According to the present invention, the orifice effectively realizing a desired hydraulic performance may be very easily and smoothly manufactured through a simple manufacturing method of forming a channel region having a cross section close to a rectangular shape by pressing a part of the capillary pipe. In addition, according to the present invention, geometric numerical values of an orifice to be manufactured, a force required for manufacturing the orifice, and the like, may be very easily calculated using given hydraulic conditions and a desired hydraulic performance, such that design and manufacturing easiness are maximized. Further, according to the present invention, the orifice itself may be very easily manufactured, and the orifice itself is formed of the single component, such that processes such as an assembling process, an aligning process, and the like, are not required at the time of manufacturing the orifice. Therefore, the number of components and the number of processes are minimized, such that economical efficiency and productivity are maximized. Therefore, a volume and a mass of the orifice are reduced, such that miniaturization and lightness of the orifice may be easily realized.

Particularly, according to the present invention, when the orifice according to the present invention is manufactured to have the same channel resistance as that of a general orifice, the orifice according to the present invention is formed to have a cross section much larger than that of the general orifice. Therefore, a problem occurring in a case of spraying a very small amount of fluid in ultra-high pressure and very low temperature environments, that is, a risk that the orifice will be blocked by foreign object particles or ice particles generated due to freezing of the residual gas may be significantly reduced as compared with a case of using the general orifice.

As described above, according to the present invention, the very small amount of fluid may be sprayed in the ultra-high pressure and very low temperature environments, and the orifice whose miniaturization and lightness are realized may be easily manufactured, and the orifice may thus be very smoothly applied to a severe and extreme environment such as a launch vehicle, or the like. In addition, since the orifice itself according to the present invention has a high economical efficiency and productivity, a production cost of an entire device such as the launch vehicle or the like to which such an orifice is applied may also be reduced.

What is claimed is:

1. A method of manufacturing an orifice, the method comprising:

a body portion preparing step of preparing a body portion in which a hollow having a circular cross section is formed;

a stress value calculating step of calculating a stress value required for a predetermined desired flow rate value according to the following relationship equation between a flow rate and a stress:

$$S = \frac{1}{C_2}\ln\left(\frac{\dot{m}}{C_1}\right),$$

wherein $\dot{m}$ is the flow rate (g/s), S is the stress ($N/m^2$), $C_1$ is a positive constant (g/s), and $C_2$ is a negative constant ($m^2/N$); and a pressed portion manufacturing step of manufacturing a pressed portion in which the hollow becomes a slit by pressing at least a partial region of the body portion with a pressing force corresponding to a value of the stress calculated in the stress value calculating step, wherein in the stress value calculating step, a value of $C_1$ is 4.0437 and a value of $C_2$ is $-3*10^{-9}$, in the pressed portion manufacturing step, an area value of the pressed portion is calculated according to the following relationship equation:

$$A = WL = \left(2_t + \frac{\pi D_i}{2}\right)L,$$

wherein A is an area ($m^2$) of the pressed portion, W is a width (m) of the pressed portion, L is a length (m) of the pressed portion, t is a thickness (m) of a wall of the body portion, and $D_i$ is an inner diameter (m) of the body portion, and the pressing force is calculated from the following relationship equation:

$$F=SA,$$

wherein F is the pressing force (N), S is the Stress ($N/m^2$), and A is the area ($m^2$) of the pressed portion.

2. The method of claim 1, wherein the pressed portion is formed in a region between both ends of the body portion.

3. The method of claim 1, wherein the pressed portion is formed from one end portion of the body portion to another end portion of the body portion.

4. The method of claim 1, wherein the body portion has a linear shape.

5. The method of claim 1, wherein the body portion has a non-linear shape.

* * * * *